US005718567A

United States Patent [19]

Rapp et al.

[11] Patent Number: 5,718,567

[45] Date of Patent: Feb. 17, 1998

[54] MICRO DIAPHRAGM PUMP

[75] Inventors: Richard Rapp, Stutensee; Helmut Kalb, Neuenstein; Walter Stark, Blaufelden; Dieter Seidel, Eggenstein-Leopoldshafen; Hans Biedermann, Bruchsal, all of Germany

[73] Assignees: Forschungszentrum Karlsruhe GmbH, Karlsruhe; Bürkert GmbH & Co. KG, Ingelfingen, both of Germany

[21] Appl. No.: 616,672

[22] Filed: Mar. 15, 1996

Related U.S. Application Data

[63] Continuation-in-part of PCT/EP94/02927, Sep. 2, 1994.

[30] Foreign Application Priority Data

Sep. 25, 1993 [DE] Germany ..... 43 32 720.6

[51] Int. Cl.[6] ..... F04B 43/06

[52] U.S. Cl. ..... 417/395; 417/479

[58] Field of Search ..... 417/479, 480, 417/395, 410.1, 410.2, 410.3, 322

[56] References Cited

U.S. PATENT DOCUMENTS

| | | | |
|---|---|---|---|
| 2,980,032 | 4/1961 | Schneider | 417/479 |
| 3,145,659 | 8/1964 | Svendsen | 417/479 |
| 4,895,500 | 1/1990 | Hök et al. . | |
| 5,171,132 | 12/1992 | Miyazaki et al. . | |
| 5,344,292 | 9/1994 | Rabenau et al. | 417/413.1 |

FOREIGN PATENT DOCUMENTS

| | | | |
|---|---|---|---|
| 0 134 614 | 3/1985 | European Pat. Off. . | |
| 0 424 087 | 4/1991 | European Pat. Off. . | |
| 0 392 978 | 10/1992 | European Pat. Off. . | |
| 887429 | 8/1953 | Germany | 417/479 |
| 41 39 668 | 6/1993 | Germany . | |
| 56-77581 | 6/1981 | Japan | 417/413.1 |
| 4066784 | 3/1992 | Japan . | |
| 1263057 | 2/1972 | United Kingdom | 417/479 |

OTHER PUBLICATIONS

Rapp 'Mit dem LIGA–Verfahren hergestelle Mikromembranpumpe', Feb. 1993, 3. Symposium Microsystmetechnik, Regensburg, Seite 125 –126.

*Primary Examiner*—Richard E. Gluck
*Attorney, Agent, or Firm*—Klaus J. Bach

[57] ABSTRACT

In a micro diaphragm pump which has a pump body consisting of two parts, one part including two valve chambers with a pump chamber disposed therebetween and in communication with the valve chambers by passages, a diaphragm extends across and closes the chambers and forms, in the areas of the valve chambers, valve membranes for inlet and outlet valves which are integrally formed, both on one side of the diaphragm, both pump body parts being sealingly connected to the diaphragm.

9 Claims, 4 Drawing Sheets

Fig. 1a
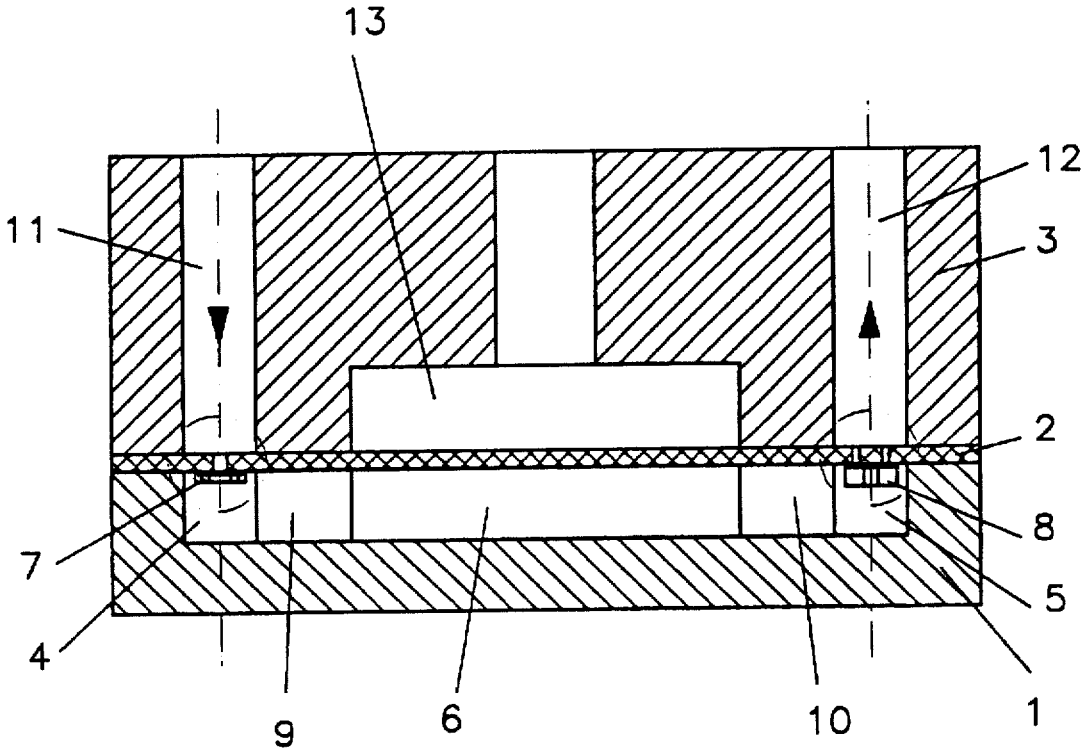
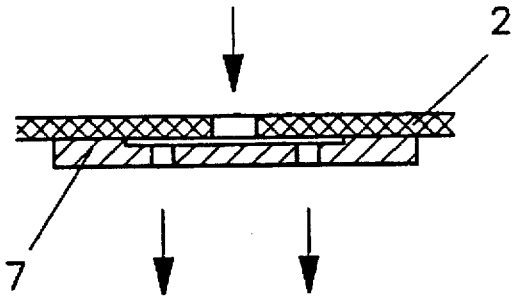
Fig. 1b
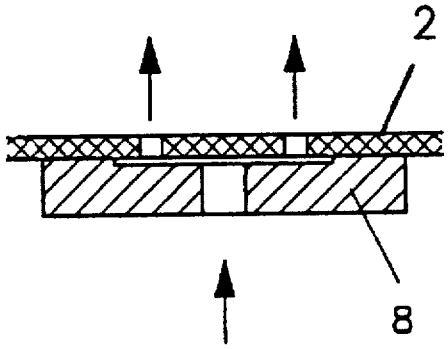
Fig. 1c

Fig. 2a
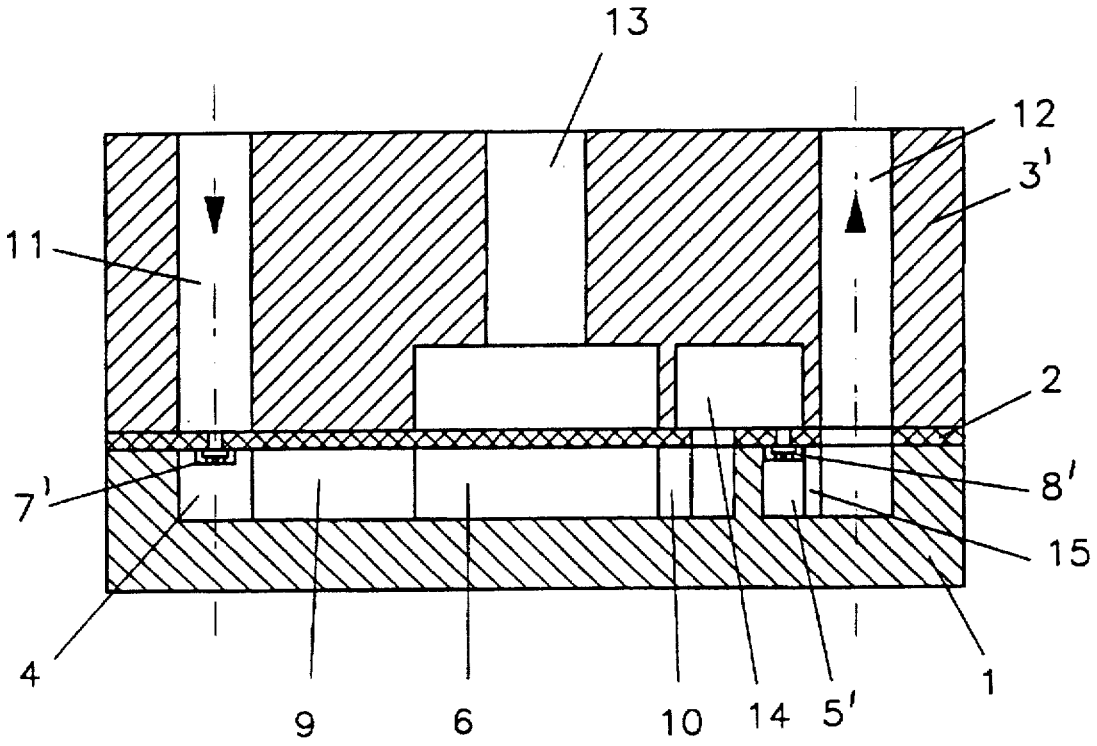
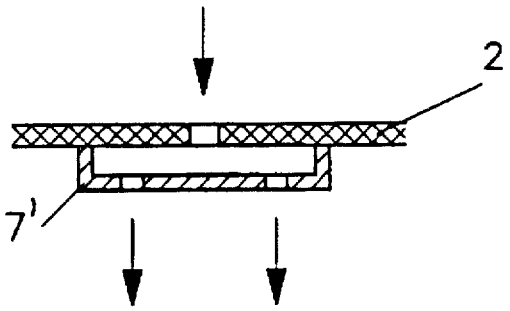
Fig. 2b
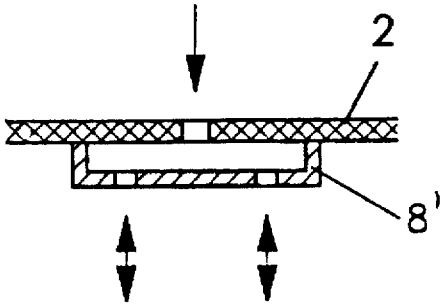
Fig. 2c

MICRO DIAPHRAGM PUMP

This is Continuation-In-Part application of international application PCT/EP94/02927 of 02 Sep. 1994 claiming the priority of German Appl. P 43 32 720.6 of 25 Sep. 1993.

BACKGROUND OF THE INVENTION

The present invention relates to a micro diaphragm pump having two valve chambers with a pump chamber arranged between the valve chambers and in communication therewith by way of channels, a pump diaphragm closing the three chambers and having valves integrally formed thereon.

Such pumps are known for example from the conference brochure Page. 124 to 133 of the 3rd Symposium Mikrosystem-technik (Microsystems Design), FH Regensburg, Feb. 17–18, 1993.

Micropumps have been manufactured so far almost exclusively utilizing silicon technologies wherein always one or more structured wafers of silicon or glass are interconnected by anodic bonding. Consequently, also the pump diaphragm consists of one of those materials.

From J. Uhlemann, T. Wetzig, W. Rotsch, "Montagetechnologie Struckurierter Flächenelemente am Beispiel einer Mikropumpe" (Assembly technology of structured area elements using as an example a Micropump) 1. Symposium Mikrosystem-technik, FH Regensburg, (1991), a pump with a glass diaphragm is known.

Further, from F. C. M. van de Pol, "A Pump Based on Micro Engineering Techniques", University of Twente, (1989) a pump with a diaphragm of a single crystal silicon is known and from S. Shaji, M. Esashi, "Fabrication of a Micropump Integrated Chemical Analyzing Systems", Electronics and Communications in Japan, part 2, vol. 72, No. 10 (1989) pp. 52–59, a pump with a valve of polysilicon is known.

Because of fabrication techniques the diaphragms of silicon have a thickness of at least 20 μm and those of glass have a thickness of at least 40 μm so that only relatively small diaphragm deflections of maximally 25 μm could be achieved. In addition, because of the bonding at the crystal planes during the anisotropic etching of the single crystal silicon, pump diaphragms with limited geometries such as square diaphragms are generated. This leads to an inhomogenous tension distribution during diaphragm deflection which further limits the acceptable deflection. Depending on the diaphragm deflection and the diaphragm thickness relatively large operating pressures are required.

Valves of silicon function on the basis of a deflection of a flexible tongue which lifts off an opening or closes the opening (reed valve). The tongue consists of silicon and is elastically deformed by the pressure difference thereacross. In order to achieve sufficient flow, such valves used to be relatively large (2–8 mm diameter) because the silicon has a relatively high module of elasticity. All pumps made on the basis of silicon are operated with liquids as flow medium. Those liquids must be essentially free of any particles to avoid malfunctioning of the valves, that is, to insure firm closing of the valves for example. Since silicon is a hydrophobic material, it is difficult to first fill the pumps with water. No operating micropump is known at this time for pumping gases.

Further, micropumps are known which have no movable parts. They are based on the electrohydrodynamic principle. Such pumps are known for example from A. Richter et al. "Elektrohydrodynasche Mikropumpen" (electrohydrodynamic micropumps), VDI Berichte 960, 1992, pp. 235–249.

However, with such pumps, only organic solvents with low electrical conductivity, such as ethanol, can be pumped. Aqueous solutions as they are needed for example in medicine technologies or gases cannot be pumped.

It is a disadvantage of the pumps referred to above that one of the two valves must be made separately, must be taken as a piece and mounted on the side of the diaphragm opposite the first valve. This requires high mounting and adjustment efforts.

It is the object of the present invention to provide such a pump where both valves can be provided on the same side of the diaphragm and the manufacturing process for the pump body is substantially simplified.

SUMMARY OF THE INVENTION

In a micro diaphragm pump which has a pump body consisting of two parts, one part including two valve chambers with a pump chamber disposed therebetween and in communication with the valve chambers by passages, a diaphragm extends across and closes the chambers and forms, in the areas of the valve chambers, valve membranes for inlet and outlet valves which are integrally formed, both on one side of the diaphragm, both pump body parts being sealingly connected to the diaphragm.

The advantages of the invention are:

- reduced manufacturing costs by substantially reduced manufacturing effort requirements.
- improved yield and quality.
- optical control of the flow by way of a transparent cover plate consisting of glass or a pump body of transparent plastic material such as PMMA or PVDF
- relatively inexpensive mass manufacture, since batch fabrication of essential components of the pump is possible,
- parallel casting of the pump body using chemically resistant, inert plastic material such as PVDF, PFA or PTFE.
- fabrication of the diaphragm and the valves with thin film techniques by way of optical lithography.

Below the invention will be described in greater detail for two exemplary embodiments on the basis of FIGS. 1–4.

BRIEF DESCRIPTION OF THE DRAWINGS

FIGS. 1*a* to 1*c* show schematically in cross-section a pump with two valves of different rigidity, FIGS. 2*a* to 2*c* show schematically in cross-section a pump with two identical valves.

FIG. 1*a* shows a pump with a lower pump body 1 which is sealingly closed at the top by a diaphragm 2. An upper pump body 3 is firmly mounted (for example by cementing) on top of the diaphragm. The lower pump body 1 includes two valve chambers 4,5 a pump chamber 6 and two channels 9, 10 which provide for communication between the valve chambers and the pump chamber.

Figure 3A:
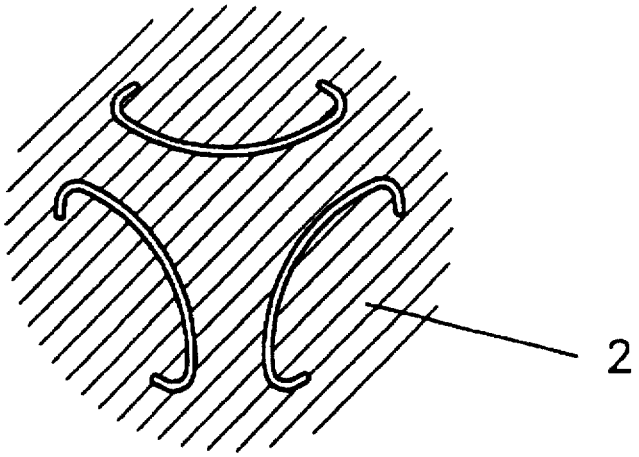
FIGS. 3*a* to 3*c* show schematically a particularly advantageous valve design.

The diaphragm 2 includes, as shown in the drawing on the left side, an inlet valve 7 and, at the right side, an outlet valve 8. The chamber 13 above the diaphragm serves as a pump drive means.

The upper pump body 3 includes inlet and outlet channels 11 and 12 for the medium to be pumped and the chamber 13 for operating the pump diaphragm 2. If the pump is driven pneumatically as it is in the present embodiment, there is provided an admission passage for the drive fluid which operates the pump by its pressure variations.

The two valves 7, 8 are shown in FIGS. 1*b* and 1*c* in an enlarged view. These valves are so designed that the rigidity of the portion structured onto the diaphragm 2 in the area of the valve 8 is smaller than that structured onto the diaphragm 2 in the area of the valve 7. The diaphragm portions in the valve areas will be called membranes. In valve 7 a center opening is formed in the valve membrane which opening is closed when the fluid .pressure downstream of the valve that is in the pump chamber 6 exceeds the pressure upstream thereof. In valve 8 a center opening is formed opposite the membrane which opening is closed when the fluid pressure downstream of the valve exceeds the pressure upstream of the valve that is in the pumping chamber 6. Excess pressure in the pump chamber 6 consequently, opens the valve 8 and closes the valve 7. The dimensions required for the valves are presented in detail later.

Figure 3B:
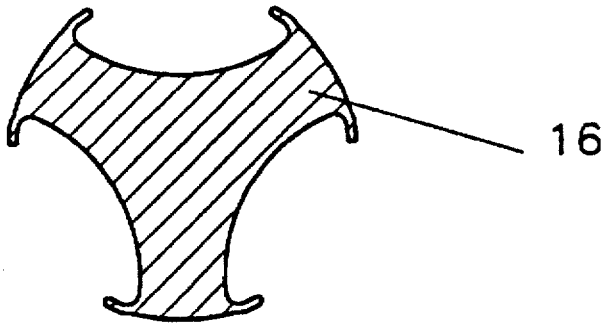
Figure 3C:
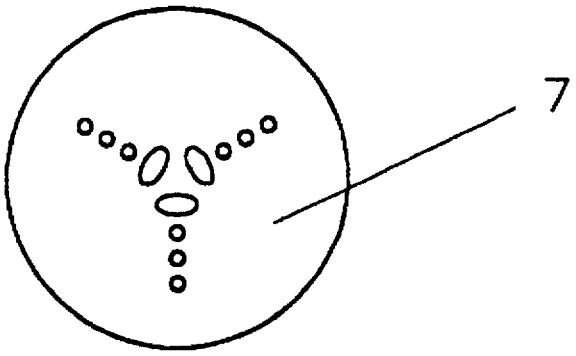

In the embodiment as shown in FIG. 2*a*, the valves 7' and 8' are identical. They are shown in an enlarged representation in FIGS. 2*b* and 2*c*. The pump as such is basically the same as that shown in FIG. 1*a*. It is different only in the area of the outlet valve 8'. Here the housing 3' includes adjacent the channel 10 ahead of the valve 8' a flow return channel 14 which extends through the diaphragm 2 and which serves to lead the fluid to the opposite side of the diaphragm 2 and the valve 8'. The valve chamber 5' is in communication with the outlet channel 12 by way of the flow passage 15 which also extends through the diaphragm 2. Instead of using a return passage 15, the outlet channel 12 could also extend through the bottom of the pump. The arrows show the direction of flow of the fluid in FIGS. 1*a*, 1*b*, 1*c* and in FIGS. 2*a*, 2*b*, and 2*c*.

in FIGS. 3*a* to 3*c*, a valve is shown which corresponds to the valve as shown in FIGS. 3*b* of DE 41 39 668 A1. The membrane 2 is the equivalent of the valve seat 3 of the reference and the valve 7, 8 is the equivalent of the valve body 6 of the reference. The valve as presented in the present application, however, has a particularly advantageous shape for the openings in the diaphragm 2 and for the valve 7, 8. The openings in the diaphragm forming the valve membrane which are shown in FIG. 3*a* are three slots which are arranged in the diaphragm 2 in the shape of a three-pointed star. The slots have the shapes of ellipses curved toward the center of the star wherein the lines extending through the large axes of the ellipse-shaped slot lines form an equal sided triangle. The slots extend beyond the apexes of the ellipse-shapes and the adjacent ends of each two slots extend outwardly in a funnel-like manner with bent-over end portions. They define therebetween the valve membrane. FIG. 3*b* shows the cavity area 16 which is present between the membrane and the valve body and which is formed by etching away a thin sacrificial layer during manufacture of the valve. At the circumference of this cavity the diaphragm and the valve body are firmly interconnected. The connecting line extends along the outer edges of the three slots up to their ends and then, in an outwardly extending arc, to the adjacent end of the adjacent slot. The cavity 16 has a three-number rotational axis normal to the plane of the drawing and three two number rotational axes in the plane of the drawing.

FIG. 3*c* shows a valve 7, 8. It includes three rows of opening arranged along lines extending radially from the center of the valve and over the three two numbered rotational axes of the cavity 16. It is to be taken into consideration that the openings in the valve body 7, 8 are sufficiently spaced from the slots in the membrane when the valve is closed and the membrane engages the valve body during valve closure. The edges of the openings are spaced from the slots by at least 40 μm. Only then a sufficient sealing effect can be achieved.

It is noted that, generally, a star-like arrangement with more than three axes can be used.

Figure 4:
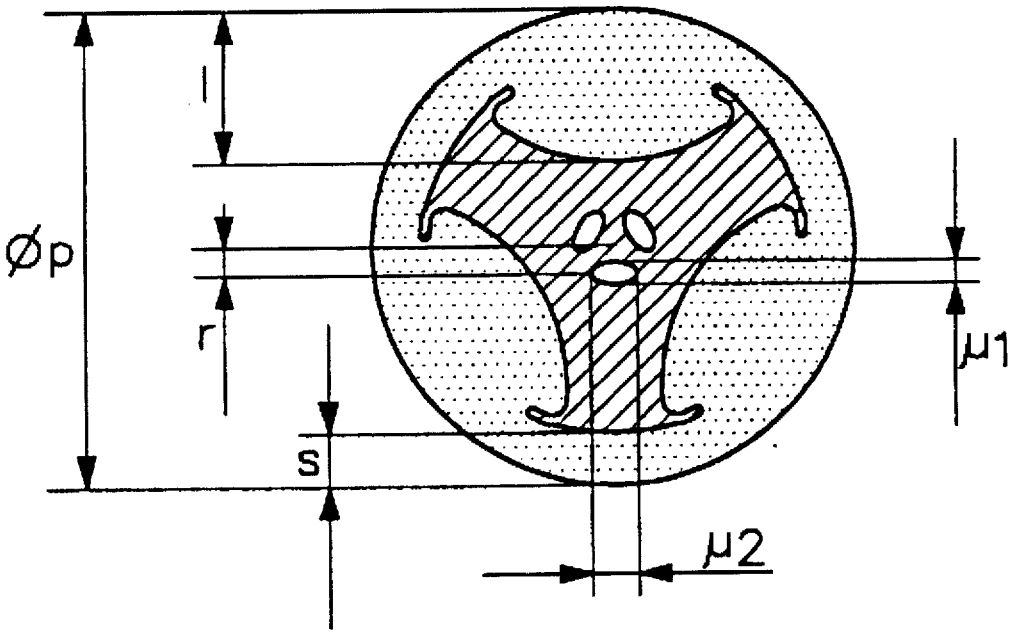
FIG. 4 shows a pump with dimensions given to indicate the size of the various parts.

In FIG. 4, an example is given with dimensions where the valve body, shown in a top view, consists of polyimide and the diaphragm consists of titanium. In the Fig, only the three center openings are shown. The other openings are not shown. They may be omitted, particularly if a metal membrane is used.

The dimensions are as follows:

$\phi_P$: 500 μm e: 155 μm r: 36 μm s: 73 μm $\mu_1$: 22 μm $\mu_2$: 55 μm

A valve with the material combination polyimide and titanium can be made in accordance with the method described in DE 41 39 668 A1.

In order to obtain values wherein the titanium diaphragm is more flexible than the valve body which consists of a polyimide membrane instead of the polyimide membrane, a thicker galvanized layer is used. As galvanizing material nickel is used since of the available galvanizing materials nickel has by far the greatest module of elasticity.

In comparison with titanium, nickel has, because of a 1.5× larger biaxial module E/(1−Y), for a body having the same thickness and the same geometry, a greater bending resistance. If furthermore, the thickness of the nickel body is substantially greater than the 2.7 μm of the titanium diaphragm, the titanium diaphragm is flexed to a greater degree than the nickel layer upon application of a differential pressure.

Like in the manufacturing process according to the publication DE 41 39 668 A1, a sacrificial layer is deposited on a structured titanium diaphragm and is also structured. Then, unlike in the process of DE 41 39 668 A1, a 16 μm photolacquer layer is deposited and, in a separate step, optically structured. Then the photolacquer is developed in a developing apparatus utilizing KOH. Subsequently, the structured photolacquer can be removed by acetone whereby the sacrificial layer is dissolved. In order to obtain a single valve, a frame is then placed onto the membrane and the titanium membrane is cut around the frame and the valve is removed from the silicon substrate. Finally, the carbon layer can be removed in an oxygen plasma.

For the various material combinations the formulas 1 to 5 given below provide indications for the design.

In the formulas, the following references are used:

Index M: diaphragm material

Index S/E: Valve material—inlet valve (for example PI)

Index S/A: valve material—outlet valve (for example Ni)

Δp: pressure difference $E^1$=E/1−r: biaxial module a: diaphragm radius with circular diaphragm d: diaphragm thickness Y: geometry factor of the diaphragm design ω: diaphragm deflection υ: lateral contraction number E: modulus of Elasticity $\sigma_o$: internal tension of the diaphragm $$\omega_{S/E} - \omega_{M/E} = \omega_{M/A} - \omega_{S/A} \quad (1)$$

$$\Delta p = \frac{4d}{a^2}\,\sigma_o \cdot \omega + \frac{8d}{3a^4}\,E'\omega^3 \quad (2)$$

$$\omega = \sqrt[3]{\frac{3}{8}\,\frac{a^4 Y}{d}\,\frac{1}{E'}\,\Delta p} \quad (3)$$

from (1) and (3):

$$\left(\frac{a^4 \cdot Y}{d \cdot E'}\right)^{1/3}_{S/E} - \left(\frac{a^4 \cdot Y}{d \cdot E'}\right)^{1/3}_{M/E} = \left(\frac{a^4 \cdot Y}{d \cdot E'}\right)^{1/3}_{M/A} - \left(\frac{a^4 \cdot Y}{d \cdot E'}\right)^{1/3}_{S/A} \quad (4)$$

wherein:

$$E'_{M/E} = E'_{M/A} = E'_M \quad (4a)$$

$$d_{M/E} = d_{M/A} = d_M \quad (4b)$$

$$a_{S/E} = a_{M/E} \quad (4c)$$

$$a_{S/A} = a_{M/A} \quad (4d)$$

Because of the requirement for equal lateral valve uses, the following applies:

$$a_{S/E} = a_{M/E} = a_{S/A} = a_{M/A} \quad (4e)$$

consequently, $$\left(\frac{Y}{d \cdot E'}\right)^{1/3}_{S/A} = \left(\frac{1}{E_M' \cdot d_M}\right)^{1/3} \cdot (Y_{M/A}^{1/3} + Y_{M/E}^{1/3}) - \left(\frac{Y}{d \cdot E'}\right)^{1/3}_{S/E} \quad (5)$$

Variation A: Both valves are geometrically identical with the exception of their thickness $$\left(\frac{Y_{M/E}}{d_{S/A} \cdot E_{S/A}'}\right)^{1/3} = \left(\frac{1}{E_M' \cdot d_M}\right)^{1/3} \cdot (Y_{S/E}^{1/3} + Y_{M/E}^{1/3}) - \left(\frac{Y}{d_{S/E} \cdot E_{S/E}'}\right)^{1/3} \quad (5a)$$

Variation B: Identical valve materials and valve thicknesses $$\left(\frac{Y_{S/A}}{d_S \cdot E_S'}\right)^{1/3} = \left(\frac{1}{E_M' \cdot d_M}\right)^{1/3} \cdot (Y_{M/A}^{1/3} + Y_{M/E}^{1/3}) - \left(\frac{Y}{d_S \cdot E_S'}\right)^{1/3} \quad (5b1)$$

and herefrom by simple transformation:

$$\left(\frac{1}{E_S \cdot d_S}\right)^{1/3} \cdot (Y_{S/A}^{1/3} + Y_{S/E}^{1/3}) = \left(\frac{1}{E_M' \cdot d_M}\right)^{1/3} \cdot (Y_{M/A}^{1/3} + Y_{M/E}^{1/3}) \quad (5b2)$$

In order to be able to compare the valve characteristics of membrane valves consisting of two membranes, the following assumptions are made:

1. The valve characteristic is determined among others by the distance between the two valve membranes under pressure. In order to obtain identical characteristics for two valves, their membrane distances under pressure must be the same (equation 1).

2. At both valves, there is the same differential pressure.

The formula for the deflection of a round membrane (without openings) under pressure is given by equation 2. Herefrom, the membrane deflection is determined with equation 3, wherein:

the internal tension of the membrane was not taken into consideration, deviations of the valve design from a circular geometry and openings in the valve membrane are taken into consideration by the geometry factor Y.

With equation 3 entered in equation 1, equation 4 is obtained which is simplified resulting in equation 5 when it is taken into consideration that:

one of the membranes (for example, the Ti membrane) consists of the same material and has the same thickness for both, the inlet and outlet valves (equation 4a or respectively, equation 4b)

the outer dimensions of all membranes (valves) are the same (equation 4c–e).

Variation A

Inlet and outlet valves have a geometrically identical design, but one of their membranes consist of different materials.

Example: Possibility 1

Inlet valve: Titanium and polyimide membranes

Outlet valve: Nickel and titanium membranes

Since both valves are identical in design only two different geometry factors are required in equation 5 for the two valve membranes. This leads to equation 5a.

If both valve membranes are identical in design (identical membrane openings, which are rotated with respect to one another), all geometry factors can be omitted in equation 5a.

Variation B

The same membrane materials with different flexibility (different designs)

Example

The inlet and outlet valves each consist of a titanium membrane and a polyimide membrane. The thickness of the titanium membrane and also of the polyimide membrane is the same in both valves because of manufacturing conditions. However, inlet and outlet valves are different with regard to their geometry factors.

This results in equation $5b_1$ and, by simple manipulation, in equation $5b_2$.

Variation C:

Different membrane materials and different flexibility (valve design) of inlet and outlet valves.

The nickel membrane was made to be as rigid as possible. That is, the nickel membrane was given a greater thickness (10 μm) when compared to the titanium membrane. Furthermore, this membrane was provided only with relatively small openings so that, in addition to the greater material rigidity, also a greater form stability (as given by the biaxial module) was obtained.

In contrast, the titanium membrane which inherently has a high material rigidity (although smaller than that of an identical nickel membrane) must be so constructed that the form stability of that membrane is Very low. This is achieved by forming in the titanium membrane a tri-pole-like structure. The arms of the tri-pole are narrow and, consequently, quite flexible. The outer contour was so selected that notch stresses were very small. This has to be observed since, otherwise, high stresses may occur in the thin titanium membranes which would result in the formation of cracks and their propagation along the structured slots, which limit and define the tri-pole structure. Outside the tripole structure, the titanium and the nickel are firmly bonded together so that a lift off movement is limited solely to the area of the tripole structure.

Possibility 2

Identical inlet and outlet valves wherein the flow medium is rerouted through an additional opening in the diaphragm at one of the inlet or outlet valves.

If identical valves are used, the flow direction through the valves must be the same for both valves. Consequently, the flow medium must be rerouted at one of the valves into an additional plane. Component 3 may again be a microstructure body made by means of the LIGA process or other structuring processes. The microstructure body may include the drive means for the pump (thermopneumatically or connections for a thermopneumatic drive). Whether re-routing is provided for at the inlet or the outlet valve depends on the valve used and on the installation location of the valve. If the valves consist each of a titanium and a polyimide membrane and the titanium membrane serves at the same time as a pump diaphragm on which the walls of the pumping chamber are built up as LIGA structures, the re-routing has to be provided for at the outlet valve. Also, the following material combinations for the diaphragm and the valves are possible:

titanium/nickel polyimide/gold

The last variation has the advantage that, for the pumping diaphragm, an extremely elastic polyimide membrane is provided.

Another possibility resides in a pump body 1, 3 consisting of plastic material made as a unitary cast. The forms for these plastic parts can be made, depending on the desired dimensions of the pump body by precision engineering procedures or by LIGA techniques. One or both of the pump bodies 1, 2 may consist of the metal. Instead of building the walls of the pump body 1 up on the diaphragm 2 and to close the pump body by mounting a cover plate thereon, the diaphragm (with valves) may be mounted onto the completed pump, for example, by welding or cementing. This has the advantage with regard to the normal pumps of this type that no additional structures have to be provided on the diaphragm.

The pump bodies 1, 3 further include the fluid connections for the inlet and outlet valves 4, 5, the re-routing channels 14, 15 and an additional chamber with a connection above the pump chamber 6 for example, for a pneumatic drive arrangement.

What is claimed is:

1. A micro diaphragm pump including a pump body with two valve chambers, a pump chamber disposed between said valve chambers and being in communication with said valve chambers by passages extending therebetween, a diaphragm extending across, and closing, said chambers, said diaphragm having, in the area of one of said valve chambers, an inlet opening with an inlet valve and means disposed on said diaphragm for closing said inlet opening and, in the area of the other of said valve chambers, an outlet opening with with an outlet valve disposed on said diaphragm for closing said outlet opening, said inlet and said outlet valves being integrally formed with said diaphragm on one side thereof, said diaphragm having sections adjacent said valves serving as valve membranes, said pump body comprising a lower and an upper part with all the chambers needed for the operation of the pump being formed in the lower pump body part and both, said lower and said upper pump body parts being sealingly connected to said diaphragm.

2. A micro diaphragm pump according to claim 1, wherein both valves are of the same design and a re-routing passage is arranged adjacent one of said valve chambers and adapted to guide a pumping medium to the opposite side of said diaphragm such that said medium flows through said valves in the same direction.

3. A micro diaphragm pump according to claim 1, wherein the rigidity of a structure formed on the membrane of one of said valves is greater than the rigidity of the structure formed on the diaphragm and the rigidity formed on the membrane of the other valve is smaller than the rigidity of the structure formed on the diaphragm.

4. A micro diaphragm pump according to claim 1, wherein said valve includes a valve disc having at least three rows of passages arranged along radially extending lines and said membrane has, in the area of said valve openings, at least three inwardly carved slots defining therebetween a flexible section for covering said passages.

5. A micro diaphragm pump according to claim 1, wherein said lower pump body part which includes said pump chambers and said valve chambers consists of plastic material.

6. A micro diaphragm pump according to claim 1, wherein said lower pump body part which includes said pump chamber and said valve chambers consists of a metal.

7. A micro diaphragm pump according to claim 1, wherein said diaphragm consists of polyimide.

8. A micro diaphragm pump according to claim 1, wherein said diaphragm consists of a metal.

9. A micro diaphragm pump according to claim 1, wherein said lower pump body part which includes said pump chamber and said valve chambers is a single piece structure.

* * * * *